US005334057A

United States Patent [19]

Blackwell

[11] Patent Number: 5,334,057

[45] Date of Patent: Aug. 2, 1994

[54] CONNECTORS FOR ELECTRICAL METER SOCKET ADAPTERS

[76] Inventor: Larry R. Blackwell, 2151 Aspenwood Ct., San Bernardino, Calif. 92404

[21] Appl. No.: 20,286

[22] Filed: Feb. 19, 1993

[51] Int. Cl.[5] ..... H01R 13/00

[52] U.S. Cl. ..... 439/839

[58] Field of Search ..... 439/691, 839, 833

[56] References Cited

U.S. PATENT DOCUMENTS

| | | | |
|---|---|---|---|
| 3,781,770 | 12/1973 | Mancini | 439/839 |
| 3,880,494 | 4/1975 | Reed et al. | 439/839 |
| 4,772,213 | 9/1988 | Bell et al. | 439/135 |
| 5,129,841 | 7/1992 | Allina et al. | 439/517 |

*Primary Examiner*—Joseph H. McGlynn
*Attorney, Agent, or Firm*—Christie, Parker & Hale

[57] ABSTRACT

A watthour meter socket adapter has a spring loaded jaw-type electrical receptacle adapted to receive a blade-like contact of a watthour meter. The electrical receptacle has a main blade member or bus bar with a terminal end portion thereof forming a first jaw at the end of the receptacle. A jaw member overlies and is rigidly secured to the main blade member, with a terminal end portion thereof forming a second jaw at the end of the receptacle. The overlying main blade member and jaw member having cooperating relatively straight contact faces that face one another on opposite sides of a narrow insertion space for receiving said blade-like contact. A narrow transverse slotted opening extends across a lower portion of the insertion space between the main blade member and the overlying jaw member. A spring member normally applies a spring biasing force to urge the contact faces toward one another for closing the space between them. The spring member comprises a continuous spring wire member of composite configuration in pressure contact with an outside face of the main blade member opposite its contact face, extending along one side of said contact faces, through said slotted opening, along the other side of said contact faces and in pressure contact with an outside face of the jaw member opposite its contact face, the spring member applying an inward biasing force on a blade-like terminal inserted into the insertion space between the contact faces of the jaws.

19 Claims, 5 Drawing Sheets

Fig. 4 PRIOR ART
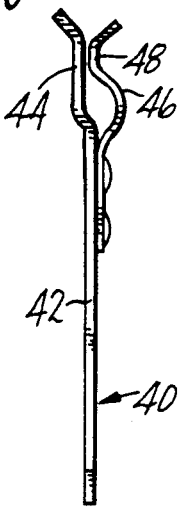
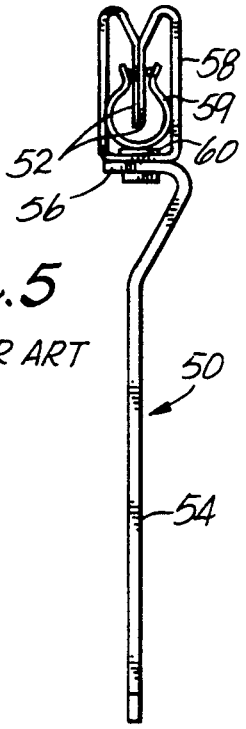
Fig. 5
PRIOR ART
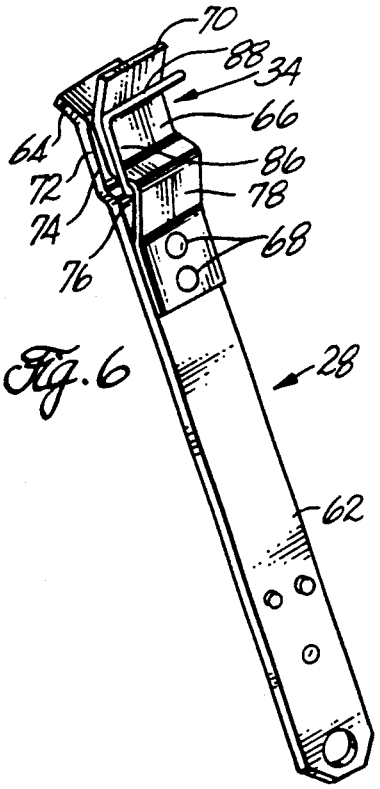
Fig. 6
Fig. 7
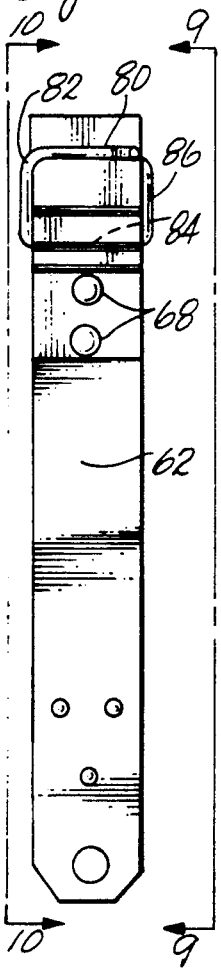
Fig. 8
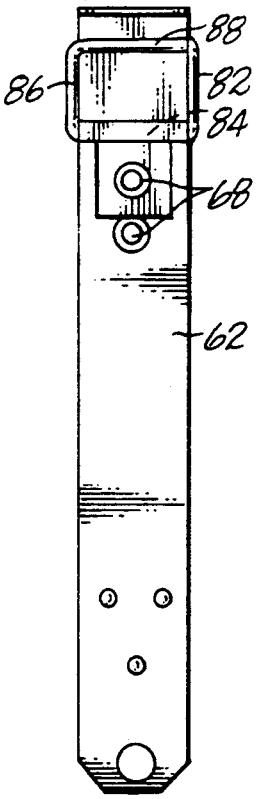
Fig. 9
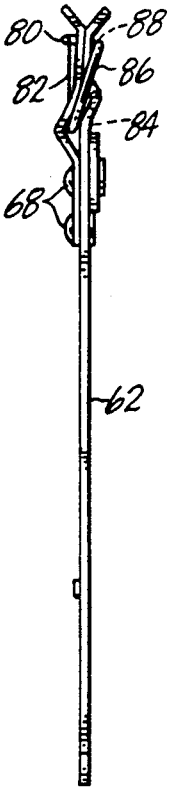
Fig. 10
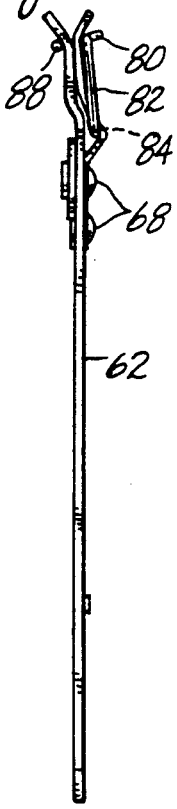

CONNECTORS FOR ELECTRICAL METER SOCKET ADAPTERS

FIELD OF THE INVENTION

This invention relates to adapters for watthour meters, and more particularly, to plug-in type connectors for connecting an electrical meter to a meter socket adapter. The invention limits heat rise developed by plug-in connectors of meter adapters sufficiently to pass standard certification testing for socket-type watthour meters.

BACKGROUND OF THE INVENTION

Electrical watthour meters are commonly used to measure the amount of electrical power consumed by an electrical utility customer. Watthour meters have the well known gauges to indicate the amount of power consumed. Typically, a watthour meter has a socket-type housing that plugs into a base or service panel having contacts connected to the building wiring. The socket-type meter being separate from the base or panel enables the meter to be easily removed and replaced without removing the entire meter base or interfering with the building wiring.

The socket-type meters commonly plug into the electrical meter base or service panel with blade-like stab connectors on the meter inserted into spring loaded jaws of cooperating receptacle-like contacts in the meter base or panel. The connectors between the socket-type meter and the meter base or panel must be designed so that the meter can be operated efficiently and safely at a certain maximum current or load level. The connections must provide a certain level of current carrying capacity, and poor contact between the connectors impedes current flow and produces corresponding heat rise at the connectors. Safety is also of paramount importance with electrical devices carrying large electrical loads, and minimal heat rise caused by the plug-in contacts when the line is operated at high loads is the objective to ensure safety. Accordingly, standard industry certification testing requires that a socket-type watthour meter inserted into a standard meter base or panel and operated at a predetermined load level must not exceed a predetermined maximum heat rise. A principal design requirement in avoiding excessive heat rise is to provide positive electrical contact between the blade-like connectors on the meter and the spring-loaded jaws of the electrical receptacles in the meter base or panel. That is, if the spring-loaded jaws of the receptacles produce good, reliable surface contact with the blade-like connectors on the meter, then the connections may not produce a heat rise problem.

In recent years, meter socket adapters or "extenders" have been installed between the watthour meter and the meter base or panel. These meter socket adapters have been used for various reasons, including providing surge protection, providing a means for converting a bottom-connected watthour meter installation to a socket-type watthour meter installation, and providing for a change in the angle of the meter face, to name a few. Meter socket adapters commonly include a socket-type housing having electrical connectors formed by bus bars which provide blade-like contacts on a back side of the housing for engaging the terminals in the meter base or panel. The other side of the contacts in the adapter housing comprise spring-loaded jaws at the ends of the bus bars that removably receive the plug-in blade-like connectors on the watthour meter.

Meter socket adapters create an additional plug-in-type blade and receptacle connection interposed in the line between the meter and the meter base, when compared with a socket-type meter that is not used with a socket adapter. Because of the additional electrical connections in the line brought about by use of the adapter, additional total heat rise is inherently produced. In addition, the socket adapters are contained in a closed housing, which entraps heat and, therefore, adds to the heat rise. Since heat rise for meter bases or panels without adapters is limited to a certain maximum amount by industry certification standards, it becomes a challenge for a line containing a meter adapter to also meet these heat rise certification standards. Certification standards (presently known as UL 414) for a conventional socket-type meter base or panel (without use of an adapter between the meter and base) require a maximum heat rise limit of 65° C. above ambient. The heat rise test for the meter base contacts is rigorous, and the heat rise test becomes increasingly more difficult to pass as the load (current) increases. The meter base or panel is subjected to a sequence of tests which include passing the rated current through the meter base or panel until constant temperatures are attained at the contacts, removing and reinserting a simulated meter for a large number of cycles while the contacts are in the heated condition, cooling to room temperature and removing and reinserting the simulated meter for a large number of cycles, cycling at 120% rated current for several hours followed by cooling, and passing 100% rated continuous current through the meter until constant temperatures are attained. The test involves measuring temperatures at potential hot spots in the contacts continuously throughout the sequence of tests.

Meter socket adapters that have previously been used in the electrical utility industry have not been required to pass these UL certification tests which are applicable to socket-type watthour meter bases or panels. An objective of the present invention is to provide a meter socket adapter that can be interposed in the line between the meter and the meter base or panel and still have the entire assembly pass the standard certification testing for socket-type watthour meter bases or panels. This includes the objective of passing the 65° C. (above ambient) maximum total heat rise test for meter bases or panels carrying high current loads. Many meter bases or panels are rated at high maximum loads of 175 amps continuous or more, and an objective of this invention is to provide an adapter that can pass the heat rise test for these rated current levels.

Meter socket adapters using presently available jaw-type receptacles are unsuccessful in limiting total heat rise sufficiently to pass the UL 414 certification test. In fact, most would fail miserably.

As mentioned previously, a principal requirement in avoiding excessive heat rise is to provide a positive electrical contact between the blade-like connectors of the meter and the spring loaded jaws of the electrical receptacles that receive the meter. The previous jaw-type contacts have included a variety of mechanisms for increasing surface contact or pressure contact, or both, between the blade and jaws. The removal and reinsertion steps in the heat rise test sequence in most cases quickly causes the spring loaded jaws to lose tension because of poor spring design that does not maintain a sufficient level of spring "memory" for a large number of insertions. Spring tension loss can result in poor contact that increases heat rise beyond acceptable certification test limits. Thus, a prior art connector that passes the UL 414 heat rise test for meter sockets may not pass the same test when the connector is used in an adapter tested for heat rise under the same standards.

In addition to heat rise, certification tests also require that the contacts meet "insertion force" specifications. Meter insertion force (the force required to insert the meter blade connectors into the jaw-type receptacle connectors of the adapter) must remain within certain limits for a number of repetitive removal and reinsertion cycles. Thus, although it may be desirable to have a strong spring force in order to improve surface contact for passing the heat rise test, excessive spring force can cause the adapter to fail the insertion force test. (Unreasonably high insertion force is undesirable because it indicates extreme difficulty in the ability to plug the meter into the socket.) On the other hand, if insertion force is too low, particularly after a few removal and reinsertion cycles of the test, it indicates poor electrical contact between the blade and jaws of the receptacle which leads to excessive heat rise.

In previously known plug-in type blade and receptacle designs, many different spring mechanisms for improving the contact force of the jaws are used. However, they often lose their spring force after only a few cycles of the insertion force test. This is particularly true for receptacle jaws biased by heavy, stiff spring wire, which deforms excessively after only a few insertions of the blades and therefore does not retain a level of insertion force to pass the heat rise test.

The present invention provides a meter socket adapter having connectors that are capable of meeting total heat rise and insertion force test standards commonly used in the certification of standard socket-type electrical meters. The invention, in fact, has passed UL 414 certification standards for heat rise (65° C. maximum heat rise above ambient at 185 amps continuous maximum load) and the related insertion force tests.

SUMMARY OF THE INVENTION

Briefly, one embodiment of the invention comprises a watthour meter socket adapter having a spring loaded jaw-type receptacle adapted to receive a blade-like contact of a watthour meter. The electrical receptacle has a main blade member with a terminal end portion thereof forming a first jaw at the end of the receptacle. The jaw member overlies and is rigidly secured to the main blade member with a terminal end portion thereof forming a second jaw at the end of the receptacle. The overlying main blade member and jaw member have cooperating relatively straight contact faces that face one another on opposite sides of a narrow insertion space for receiving the blade-like contact of the meter. A narrow transverse slotted opening extends across a lower portion of the insertion space between the main blade member and the overlying jaw member. A spring member normally applies a spring biasing force to urge the contact faces toward one another for closing the insertion space between them. The spring member comprises a continuous spring wire member of composite configuration in pressure contact with an outside face of the main blade member opposite its contact face, the wire extending along one side of the contact faces, through the slotted opening, along the other side of the contact faces and in pressure contact with an outside face of the jaw member opposite its contact face, the spring member applying an inward biasing force on a blade-like contact from a meter inserted into the space between the contact faces of the main blade member and the jaw member.

In use, the jaw-type receptacle of this invention, owing to the biasing force provided by the spring member, applies an insertion force to the meter blade contact that results in a maximum heat rise well within certification limits of UL 414 while also passing insertion force tests. The surprising result is that the receptacle of this invention is able to pass such heat rise and insertion force tests after rigorous test procedures involving repetitive removal and reinsertion of the blade-like contacts in the receptacle of this invention.

These and other aspects of the invention will be more fully understood by referring to the following detailed description and the accompanying drawings.

BRIEF DESCRIPTION OF THE DRAWINGS

FIG. 4 is an elevational view illustrating one embodiment of a prior art jaw-type receptacle for a meter socket adapter.

FIG. 5 is an elevational view illustrating a further prior art embodiment of a jaw-type electrical receptacle for a meter socket adapter.

FIG. 6 is a perspective view of the jaw-type electrical receptacle contact for the meter adapter of this invention.

FIG. 7 is an elevational view showing one side of the receptacle of FIG. 6.

FIG. 8 is an elevational view showing a reverse side of the connector of FIG. 7.

FIG. 9 is a side elevational view taken on line 9—9 of FIG. 7.

FIG. 10 is a side elevational view taken on line 10—10 of FIG. 7.

DETAILED DESCRIPTION

Figure 1:
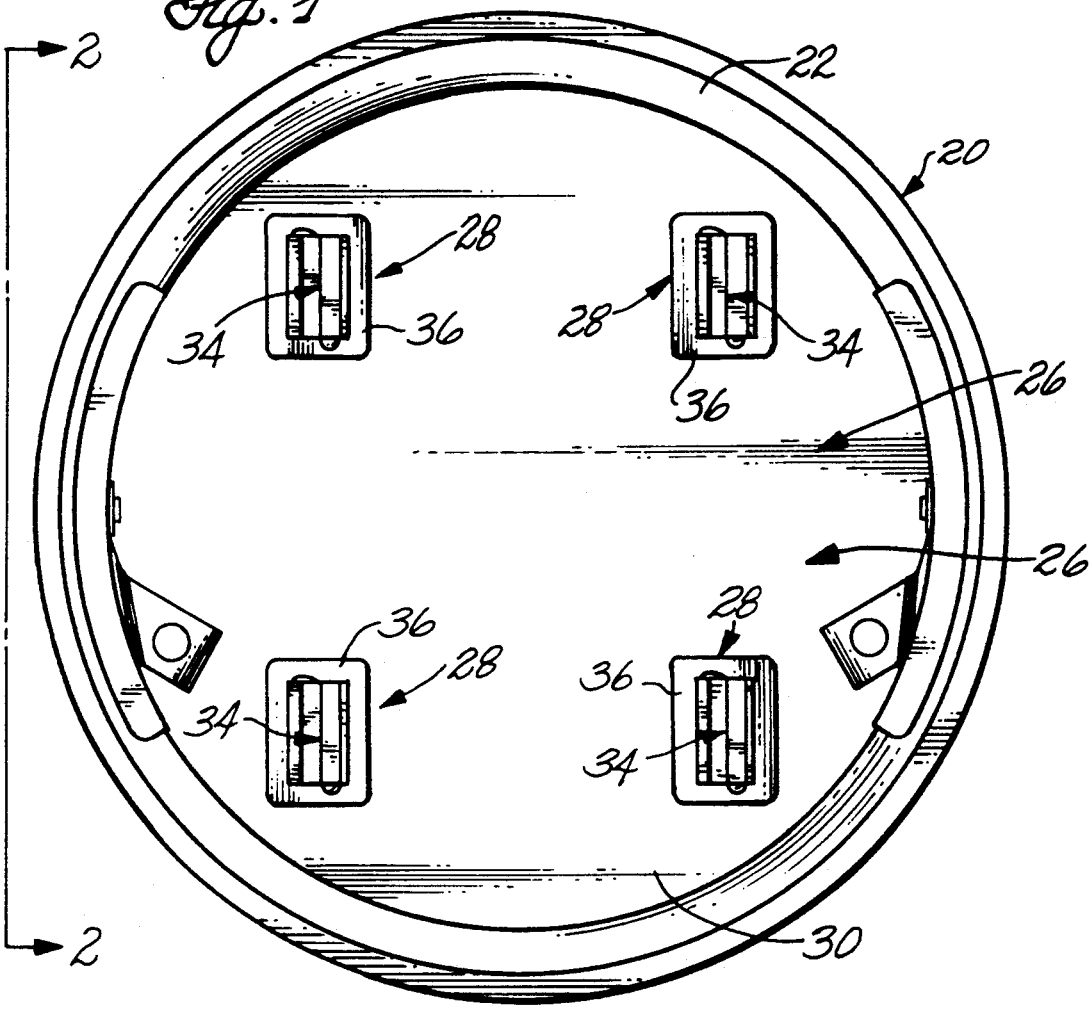
FIG. 1 is a front elevational view showing an electrical meter socket adapter having spring loaded jaw-type receptacle contacts according to principles of this invention.
Figure 2:
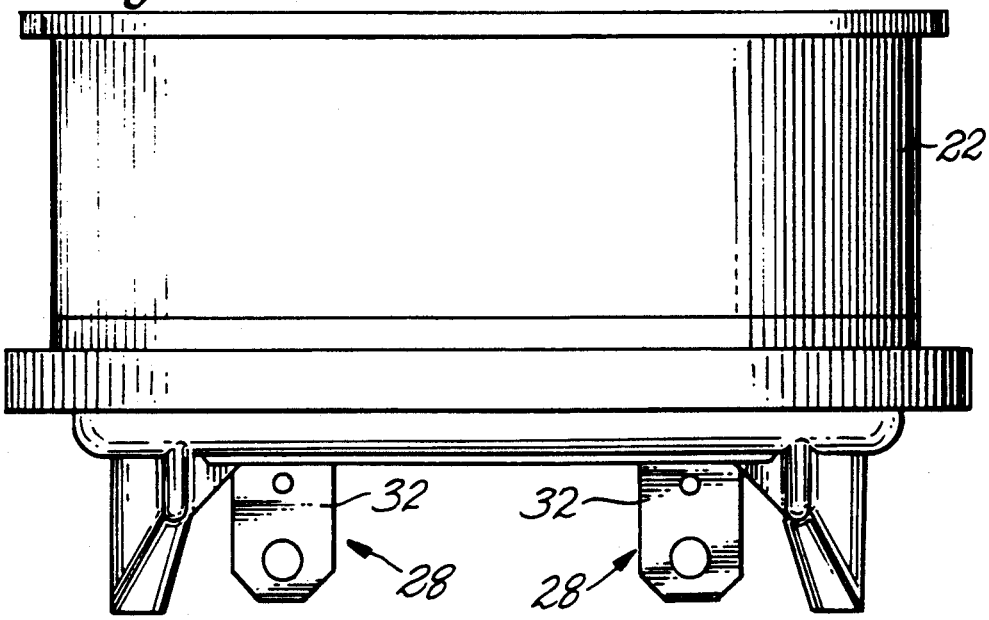
FIG. 2 is a side elevational view of the adapter taken on line 2—2 of FIG. 1.
Figure 3:
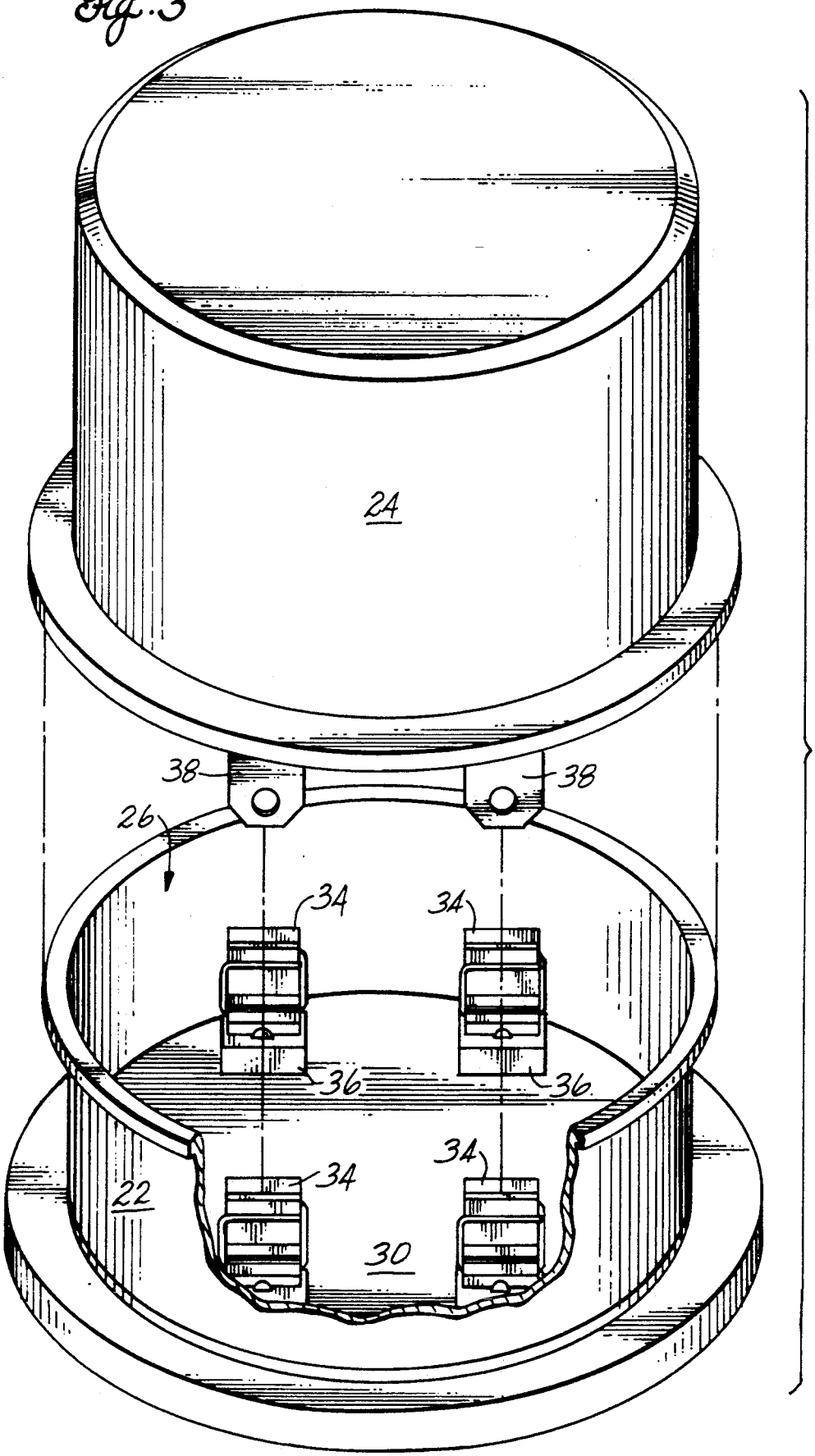
FIG. 3 is an exploded perspective view, partly broken away, showing insertion of contacts on a watthour meter into a socket adapter having the electrical terminals of this invention.

FIGS. 1 through 3 show a meter socket adapter 20 of this invention. The adapter includes a cylindrical housing 22 for receiving a socket-type watthour meter 24 inserted into a hollow interior region 26 of the housing. The interior of the adapter housing has a group of four electrical contacts 28 facing from the inside of the housing. The contacts are preferably spaced apart on a familiar rectangular pattern. The contacts comprise bus bars that extend through a base 30 of the housing to a back side of the housing where blade-like terminals 32 of the bus bars project away from the rear face of the housing. The electrical contacts 28 on the inside of the housing comprise spring loaded jaw-like receptacles 34 arranged on the bus bars according to principles of this invention. The illustrated adapter housing has four contact mounting bases 36 integrally formed with the base 30 of the adapter. The contact mounting bases have raised portions which secure the jaw-like terminals 34 of the contacts so that they are held in fixed positions within the adapter housing for engagement with corresponding elongated blade members 38 of the watthour meter 24. When the meter 24 is plugged into the adapter, the closed housing formed by the adapter can reduce heat dissipation during operation.

To better appreciate the invention, several prior art electrical contacts will first be described. FIGS. 4 and 5 illustrate two embodiments of prior art jaw-type receptacles for blade-like connectors of watthour meters. The receptacles are commonly used as connectors in electrical socket-type meters for connection to the blade-like stab connectors on the meter. FIG. 4 shows a prior art jaw-type receptacle 40 of low profile, two-piece construction having a main blade member or bus bar 42 forming one jaw 44 of the connector. A second jaw member 46 of complex S-shape is bent into its complex configuration for the purpose of applying a spring biasing force to a blade member inserted into the narrow space between the jaws. The second blade member is bent into its S-shaped configuration which produces a small surface area of point contact at 48 for contact with the blade inserted into the receptacle. This connector may pass low load level (165 amp loads) certification testing for use in a meter socket. However, this small area of contact and the low spring force produced by the S-shaped jaw member would result in excessive heat build-up and failure of standard heat rise (maximum 200 amp load) certification tests (UL 414) if this connector were used in a meter adapter.

FIG. 5 illustrates a prior art connector 50 with complexly configured blade receiving jaws 52 that produce greater surface area contact, with an inserted blade-like connector, than the connector 40. The connector 50 includes a main blade member or bus bar 54 having a "candy cane" shape with a flat upper base 56 that supports the jaws. The jaws are formed at the ends of internal reverse bends of a box-shaped metal piece 58. In this configuration the jaws do not easily retain their spring biased properties and, therefore, are reinforced for spring tension by an internal U-shaped spring member having its opposite sides applying a spring force on the jaws 52. The box-shaped metal piece that forms the jaws is fastened to the candy cane shaped blade member by a fastener 60. A connector of the type shown in FIG. 5 may pass certification tests for use in a meter socket, but it suffers from several problems if used in a meter adapter. These include development of excessive hot spots at the point where the fastener 60 attaches the base of the box-like jaw member to the blade member 54, and the possibility of inaccurate alignment resulting in misalignment of the positioning of the axis through the opposed faces of the jaws (due to excessive tolerances in the bend of the flat upper portion 56 of the blade member and the alignment of the complexly-shaped jaw member 58 on the end of the blade member). The connector 50 also is excessively costly to manufacture and requires a slotted opening through the bus bar near the fastener 60 which adds to heat rise. (The opening is necessary to gain access to the fastener holding the connector to the bus bar.)

A further prior art connector is described in U.S. Pat. No. 5,129,841 to Allina et al. The connector disclosed in the '841 patent does not maintain the necessary level of spring force after repeated insertions of the meter blades to retain surface contact sufficient to pass heat rise tests, particularly for the higher current load levels.

Figure 11:
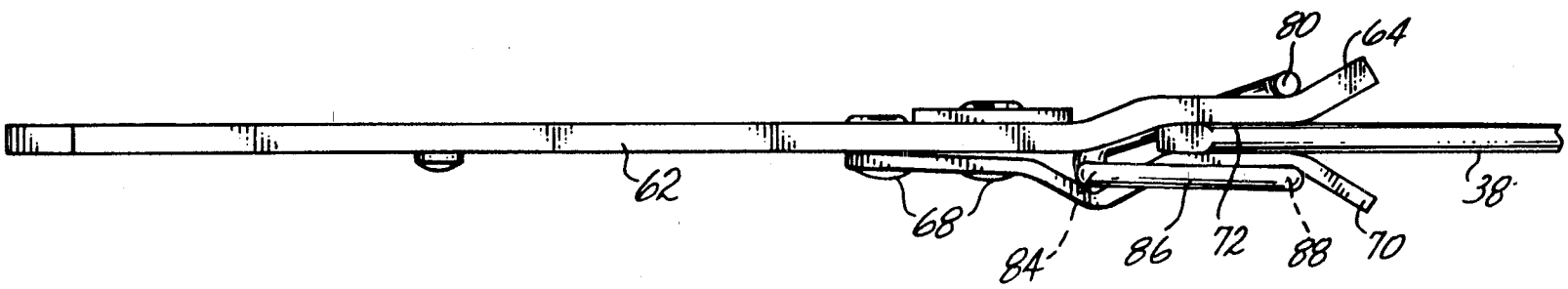
FIG. 11 is an enlarged side elevational view illustrating the connector of this invention in use as a receptacle for a blade-like terminal connector of a watthour meter.

FIGS. 6 through 10 illustrate detailed construction of the jaw-type receptacle 34 of the meter socket adapter contacts 28 according to this invention. The electrical receptacle has a main blade member or bus bar 62 with a terminal end portion forming a first jaw 64 at the end of the receptacle 34. A jaw member 66 overlies and is rigidly secured to the main blade member by fasteners 68. A terminal end portion 70 of the jaw member forms a second jaw at the end of the receptacle. The overlying main blade member and jaw member have cooperating relatively straight and parallel contact faces 72 and 74 that face one another on opposite sides of a narrow insertion space formed between the elongated flat faces 72 and 74. The narrow insertion space is for receiving the blade-like contacts 38 of a watthour meter such as the meter 24. A narrow transverse slotted opening 76 extends across and opens into a lower portion of the insertion space between the main blade member and the overlying jaw member. The narrow slotted opening 76 is formed between the main blade member and an outward V-bend portion 78 of the jaw member below the contact faces 72 and 74. The opening extends generally perpendicular to the long axis of the blade-like connector. A spring member 80 normally applies a spring biasing force to urge the contact faces of the jaws toward one another for closing the insertion space between them. The spring member comprises a continuous spring wire member bent into a composite configuration having a first leg 80 in pressure contact with an outside face of the main blade member opposite its contact face, a second leg 82 bent at a right angle to the first leg 80 and extending along one side of the contact faces of the jaws, a third leg 84 bent at a right angle to the second leg 82 and extending through the slotted opening, a fourth leg 86 bent at a right angle relative to the third leg 84 and extending along the other side of the contact faces of the jaws, and a fifth leg 88 bent at a right angle relative to the fourth leg 86 and in pressure contact with an outside face of the jaw member opposite from its contact face. The ends of the jaws above the contact faces are flared apart to provide an entrance opening to the insertion space between the contact faces of the jaws. The spring member applies an inward biasing force on a blade-like terminal inserted into the insertion space between the contact faces of the jaws. FIG. 11 illustrates a blade-like connector 38 extended into the insertion space between the flat contact faces 72 and 74 of the jaws. The first and fifth legs of the spring member are retained on the outside faces of the jaw members at the base of each flared end of the jaw. The spring wire member is normally maintained in tension with the side legs 82 and 86 of the spring applying leverage to the legs 80 and 88 for applying inward spring biasing force toward the contact faces of the jaw members to normally close the jaws of the receptacle by a large force induced toward the contact faces of the jaws. This produces large surface area contact from the large area flat contact faces of the jaws.

In one embodiment of the invention, the main blade member 62 comprises an alloy 110 copper bus bar 0.095 inch thick and 0.750 inch wide. The jaw member 66 is spring phosphorous bronze 0.048 inch thick and 0.750 inch wide. The spring member is about 0.062 inch to about 0.067 inch diameter music wire (ASTM A 228). The jaws are aligned on a common axis so that the receptacles 28 can be used in a meter socket adapter independently of reversal. The contact faces 72 and 74 of the jaw members are preferably substantially equal in length and width and arranged to make a large surface area of contact (0.750 in.×0.500 in.) with the blade member as illustrated best in FIG. 11.

Figure 12:
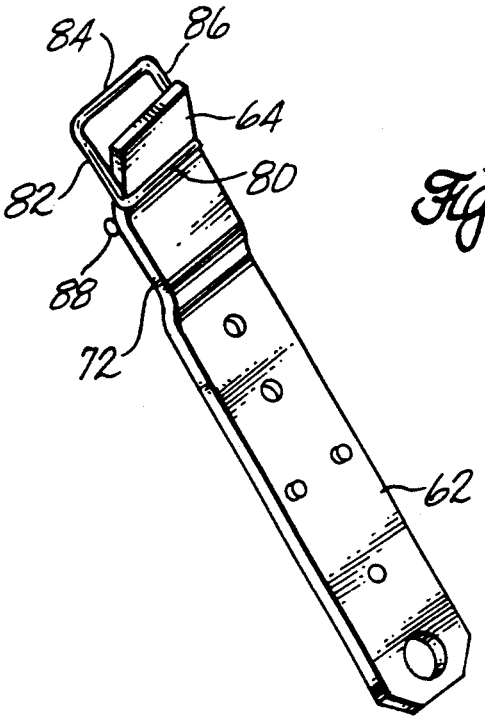
FIG. 12 is a perspective view illustrating a first step in a process for applying a spring member to the connector of this invention.
Figure 13:
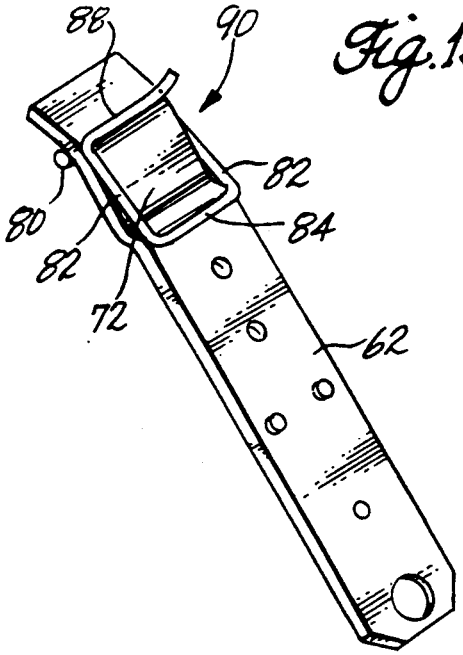
FIG. 13 is a perspective view illustrating a second step in the sequence of applying the spring member to the connector.

FIGS. 12 and 13 illustrate the first two steps in a process for applying the spring member to the connector. In FIG. 12, which shows a first step in the process, the spring wire is in an inverted position with the first leg 80 at the base of the flared jaw end 64 of the blade member. In this position the third leg 84 of the spring member is inverted above the blade member and the fifth leg 88 is at the base of the flared end 64 of the jaw member on the opposite side from the first leg 80. The contact face 72 of the blade member is opposite from the side of the blade member shown in FIG. 12, but this face 72 of the blade member is shown in FIG. 13. In the first two steps of the process shown in FIGS. 12 and 13, the jaw member 70 is detached from the blade member 62. The spring member is rotated from the position shown in FIG. 12 to the position shown in FIG. 13 where the third leg of the spring member 84 is rotated downwardly to the vicinity of below the contact face 72. In this position, the first and fifth legs 80 and 88 of the spring member remain on opposite sides of the blade member near the base of the flared end of the jaw. This twists the spring member and activates it so that it applies a strong biasing force to the jaw members, applying the force normally to the space between the adjacent contact faces of the jaw members. The process is then completed by attaching the blade member 70, by slipping the blade member 70 from the side under the end of the fifth leg 88 of the spring member in the direction of the arrow 90 shown in FIG. 13.

EXAMPLE

A meter socket adapter having the terminal contacts 28 according to this invention was installed in a meter service panel and tested, according to UL 414 test certification standards, for heat rise and insertion force. The contacts were made according to the previous description, and 0.062 inch music wire was used for the biasing spring. The contacts were installed in a meter socket adapter housing as previously described. The test was conducted for bus bars of varying length, long bus bars 5½ and 4½ inches in length, and a short bus bar 3½ inches in length. Certification tests were conducted for different load levels, a maximum load level of 200 amps (185 amps continuous) and a lower level of 175 amps continuous.

A simulated meter was first inserted and re-inserted into the adapter contacts five times, after which the meter socket adapter was subjected to the following sequence of tests:

1. One hundred percent of rated continuous current was passed through the device until constant temperatures were obtained.

2. The simulated meter was then removed and reinserted thirteen times while the device was still in the heated condition 3. The meter socket was allowed to cool to room temperature and the meter was removed and reinserted twelve times.

4. A cycling test of sixteen cycles with one hundred twenty percent rated current "on" for two hours and "off" for one hour.

5. One hundred percent of rated continuous current was passed through the device until constant temperatures were obtained.

The meter socket adapter having the contact terminals of this invention passed the 175 amp (continuous) test for both short and long bus bars. The socket adapter also passed the 185 amp (continuous) test for the short bus bars. Maximum heat rise (worst case) during testing was 55° C. above ambient, well within the maximum 65° above ambient limit established by current UL 414 certification standards.

The heat rise tests also measured durability by requiring that on the last test, the heat rise cannot exceed the heat rise measured on the first test by more than 7° C. All meter socket adapters having the contacts of this invention passed the durability test.

The meter socket adapter also was subjected to insertion force tests which involved five insertions of the meter blades in the meter adapter. Test standards require that insertion force not exceed 100 lbs in any operation. The insertion test determines whether the spring biased jaws will maintain jaw memory sufficient to produce the necessary surface contact on the blade members after a number of removals and reinsertions of a meter. (The blade member typically widens the gap when inserted even once and therefore maintaining long term insertion force is necessary to avoid heat rise problems.) The test results of the meter socket adapter containing the contacts of this invention passed the insertion force tests. Insertion force initially measured 80 lbs and only dropped to about 70 lbs (permanent) during the last insertion of the test sequence. The contacts remained at 70 lbs permanent for as many as one hundred insertions.

What is claimed is:

1. A watthour meter socket adapter having a spring loaded jaw-type electrical receptacle adapted to receive a blade-like contact of a watthour meter, the electrical receptacle having a main blade member with a terminal end portion thereof forming a first jaw at the end of the receptacle, a jaw member overlying and rigidly secured to the main blade member with a terminal end portion thereof forming a second jaw at the end of the receptacle, the overlying main blade member and jaw member having cooperating relatively straight contact faces that face one another on opposite sides of a narrow insertion space for receiving said blade-like contact, a narrow transverse slotted opening extending across a lower portion of the insertion space between the main blade member and the overlying jaw member, and a spring member normally applying a spring biasing force to urge said contact faces toward one another for closing the space between them, the spring member comprising a continuous spring wire member of composite configuration in pressure contact with an outside face of the main blade member opposite its contact face and in pressure contact with an outside face of the jaw member opposite its contact face for applying an inward biasing force on said blade-like contact inserted into the insertion space between said contact faces, the spring wire member having legs integral with each other and bent at right angles with respect to each other and comprising a first leg on the outside face of the main blade member spaced from and generally parallel to said narrow slotted opening, a second leg extending along a first side of the contact faces from the first leg into said narrow slotted opening, a third leg extending from the second leg through the slotted opening, a fourth leg extending from the third leg in the narrow slotted opening along a second side of the contact faces, and a fifth leg extending from the fourth leg along the outside face of the jaw member spaced from and generally parallel to said narrow slotted opening.

2. Apparatus according to claim 1 in which the receptacle has an insertion force of less than 100 pounds and greater than about 70 pounds.

3. Apparatus according to claim 1 in which the receptacle has a permanent insertion force of at least about 70 pounds.

4. Apparatus according to claim 1 in which the receptacle is adapted to carry a current of at least 175 amps (continuous) and in which the maximum heat rise for a standard meter blade connector (UL 414 certification standard) is less than 65° C. above ambient.

5. Apparatus according to claim 1 in which the spring member comprises music wire.

6. Apparatus according to claim 5 in which the music wire has a diameter from about 0.062 to about 0.067 inch.

7. In a watthour meter socket adapter having a jaw-type electrical receptacle adapted to receive a blade-like contact of a watthour meter, an improved electrical receptacle having a main blade member with a terminal end portion thereof forming a first jaw at the end of the receptacle, a jaw member overlying and rigidly secured to the main blade member with a terminal end portion thereof forming a second jaw at the end of the receptacle, the overlying main blade member and jaw member having cooperating relatively straight contact faces that face one another on opposite sides of a narrow insertion space for receiving said blade-like contact, a narrow transverse slotted opening extending across a lower portion of the insertion space between the main blade member and the overlying jaw member, and a spring member normally applying a spring biasing force to urge said contact faces toward one another for closing the space between them, the spring member comprising a continuous spring wire member of composite configuration in pressure contact with an outside face of the main blade member opposite its contact face and in pressure contact with an outside face of the jaw member opposite its contact face for applying an inward biasing force on said blade-like contact inserted into the insertion space between said contact faces, the spring wire member having legs integral with each other and bent at right angles with respect to each other and comprising a first leg on the outside face of the main blade member spaced from and generally parallel to said narrow slotted opening, a second leg extending along a first side of the contact faces from the first leg into said narrow slotted opening, a third leg extending from the second leg through the slotted opening, a fourth leg extending from the third leg in the narrow slotted opening along a second side of the contact faces, and a fifth leg extending from the fourth leg along the outside face of the jaw member spaced from and generally parallel to said narrow slotted opening.

8. The improvement according to claim 7 in which the receptacle has an insertion force of less than 100 pounds and greater than about 70 pounds.

9. The improvement according to claim 7 in which the receptacle has a permanent insertion force of at least about 70 pounds.

10. Apparatus according to claim 7 in which the receptacle is adapted to carry a current of at least 175 amps (continuous) and in which the maximum heat rise for a standard meter blade connector (UL 414 certification standard) is less than 65° C. above ambient.

11. The improvement according to claim 7 in which the spring member comprises music wire.

12. The improvement according to claim 11 in which the music wire has a diameter from about 0.062 to about 0.067 inch.

13. A watthour meter socket adapter having a spring loaded jaw-type electrical receptacle adapted to receive a blade-like contact of a watthour meter, the electrical receptacle having a main blade member with a terminal end portion thereof forming a first jaw at the end of the receptacle, a jaw member overlying and rigidly secured to the main blade member with a terminal end portion thereof forming a second jaw at the end of the receptacle, the overlying main blade member and jaw member having cooperating relatively straight contact faces that face one another on opposite sides of a narrow insertion space for receiving said blade-like contact, a narrow transverse slotted opening extending across a lower portion of the insertion space between the main blade member and the overlying jaw member, and a spring member normally applying a spring biasing force to urge said contact faces toward one another for closing the space between them, the spring member comprising a continuous spring wire member of composite configuration in pressure contact with an outside face of the main blade member opposite its contact face, extending along one side of said contact faces, through said slotted opening, along the other side of said contact faces and in pressure contact with an outside face of the jaw member opposite its contact face, for applying an inward biasing force on said blade-like contact inserted into the insertion space between said contact faces, the spring member producing sufficient pressure contact so that the receptacle carrying a maximum load level of 185 amps (continuous) has a maximum heat rise for a standard meter blade connector of less than 65° C. above ambient with an insertion force in a range from about 70 to about 100 pounds.

14. Apparatus according to claim 13 in which the spring member comprises music wire having a diameter from about 0.062 to about 0.067 inch.

15. Apparatus according to claim 13 in which the spring member has leg portions thereof biased against the outside faces of the main blade member and the jaw member spaced from and substantially parallel to the narrow slotted opening, the legs integral with each other through continuous connections to opposite ends of a single leg of the spring member extending through the narrow slotted opening.

16. A watthour meter socket adapter having a spring loaded jaw-type electrical receptacle adapted to receive a blade-like contact of a watthour meter, the electrical receptacle having a main blade member with a terminal end portion thereof forming a first jaw at the end of the receptacle, a jaw member overlying and rigidly secured to the main blade member with a terminal end portion thereof forming a second jaw at the end of the receptacle, the overlying main blade member and jaw member having cooperating relatively straight contact faces that face one another on opposite sides of a narrow insertion space for receiving said blade-like contact, a narrow transverse slotted opening extending across a lower portion of the insertion space between the main blade member and the overlying jaw member, and a spring member normally applying a spring biasing force to urge said contact faces toward one another for closing the space between them, the spring member comprising a continuous spring wire member of composite configuration in pressure contact with an outside face of the main blade member opposite its contact face, extending along one side of said contact faces, through said slotted opening, along the other side of said contact faces and in pressure contact with an outside face of the jaw member opposite its contact face, for applying an inward biasing force on said blade-like contact inserted into the insertion space between said contact faces, the spring wire member having first and second leg portions thereof biased against the outside faces of the main blade member and the jaw member at locations thereon spaced from and substantially parallel to the narrow slotted opening, the first and second legs being integral with each other through continuous connections to opposite ends of a single third leg portion of the spring member extending through the narrow slotted opening.

17. Apparatus according to claim 16 in which the spring member comprises music wire having a diameter from about 0.062 to about 0.067 inch.

18. Apparatus according to claim 16 in which the receptacle has a permanent insertion force of at least about 70 pounds.

19. Apparatus according to claim 16 in which the spring member produces sufficient pressure contact so that the receptacle carrying a maximum load level of 185° amps (continuous) has a heat rise for a standard meter blade connector of about 65° C. above ambient.

* * * * *